United States Patent [19]

Cobb

[11] 4,059,091

[45] Nov. 22, 1977

[54] HEAT SAVING CONCEALED FIREPLACE FRONT

[76] Inventor: Lawrence R. Cobb, 827-6th Ave., Lake Odessa, Mich. 48849

[21] Appl. No.: 691,858

[22] Filed: June 1, 1976

[51] Int. Cl.[2] ..... F24C 15/10

[52] U.S. Cl. ..... 126/140; 126/143; 126/202; 49/410

[58] Field of Search ..... 126/138, 140, 202, 120, 126/143; 49/409, 410, 411

[56] References Cited

U.S. PATENT DOCUMENTS

| | | | |
|---|---|---|---|
| 2,791,005 | 5/1957 | Thompson | 49/409 |
| 3,976,048 | 8/1976 | Ashman, Jr. | 126/140 X |

FOREIGN PATENT DOCUMENTS

| | | | |
|---|---|---|---|
| 1,395,169 | 4/1963 | France | 49/410 |
| 575,597 | 2/1946 | United Kingdom | 126/202 |
| 199,995 | 7/1923 | United Kingdom | 126/202 |

*Primary Examiner*—Ronald C. Capossela
*Attorney, Agent, or Firm*—McGarry & Waters

[57] ABSTRACT

A front for a fireplace comprises a concealed fireplace door that slides into and out of a concealed door pocket formed at the side of the fireplace. The door completely seals the fireplace front when in its closed position and a fire is burning in the fireplace. An airvent is provided in a pocket behind the concealed door pocket for admitting fresh air to the fireplace from a source outside of the enclosure when the door is closed. The door is removably suspended from a carriage assembly that rides over the fireplace opening on a two-section track, which can be disassembled for installing and removing the track from the fireplace. The door can be mounted on the carriage assembly by means of studs on the door which removably engage slots in a frame carried by the carriage assembly. Alternatively, the door can be mounted by means of key-shaped slots in the door which engage flared projections extending downwardly from the carriage assembly.

11 Claims, 11 Drawing Figures

HEAT SAVING CONCEALED FIREPLACE FRONT

BACKGROUND OF THE INVENTION

1. Field of the Invention

This invention relates to fireplace fronts and more particularly to an improved heat saving fireplace front employing a concealed fireplace door of improved design that seals the front of the fireplace when in its closed position and a vent mechanism that provides an independent air supply to the fireplace when the door is closed.

2. Description of the Prior Art

With the increased cost of home heating fuels, more attention has been directed toward the possibility of heating a home by means of a conventional wood-burning fireplace. A conventional fireplace, however, is extremely inefficient in heating a home.

One problem with most conventional fireplaces is that the open flue in the fireplace acts as an open window, and the strong updraft in the flue draws warm air from the room and the heated air in the fireplace up the chimney and out of the house. With an air flow pattern of this nature, there is no convection heating at all and there is even a heat loss, due to the fact that furnace-heated air in the house is drawn into the fireplace and discharged from the house through the chimney.

This heat loss may be sufficiently offset to produce some net heating effect for the room by the radiant heat produced by the burning fire. The convection heat loss, however, minimizes the net heating effect produced by the radiant energy. Moreover the net heating effect is present only when the fire is burning brightly and turns into a net heat loss when the fire begins to die out.

Since most fires are permitted to die out at night, when the homeowners go to bed, the flue is left open all night so that the smoke from the fire will be vented from the house. The problem this produces is that once the fire ceases to burn brightly, the radiant heating effect produced by the fire diminishes, but the flue continues to act essentially as an open window drawing warm air from the room upwardly and out of the chimney.

As a result, the use of a fire in a conventional home or other such dwelling produces an overall net heating loss for the dwelling, notwithstanding the fact that a substantial amount of wood has been blazing brightly in the fireplace, at considerable expense to the owner of the dwelling.

Another problem with conventional fireplace design is that the heated room air drawn into the fireplace creates a pressure drop inside the room, and this pressure drop is balanced by the flow of cold outside air into the dwelling through cracks around windows or doors or the like. Thus, although the radiant heat from the fireplace may warm the room in which the fireplace is located, the outside draft produced by the fireplace will cause a chill in the other rooms of the dwelling. In a home that is particularly well insulated such that drafts are minimized, the fireplace either will not draw at all, and hence the fire will burn poorly in the fireplace, or the fireplace will draw air from beneath an outside door. In wet weather, when snow or water are present on the outside of the door, the cold draft under the door can actually suck the water under the door and into the dwelling, thus causing a mess on the inside floor adjacent the door.

One method heretofore developed for improving an air supply to a fireplace is to provide a separate air supply to the fireplace by an air supply drawing air from another room or from a vent outside the building. This type of air supply, however, does not eliminate the heat loss problem, and it does not eliminate air-draft from the room into the fireplace. It merely provides an improved air-draft that facilitates the burning of the fire.

Fireplace doors, as such, are known, as are concealed fireplace doors. Some fireplace doors also have been designed to seal off the front of a fireplace, thereby presumably cutting off all air to the fireplace and extinquishing the fire.

One object of the present invention is to provide a fireplace front that reduces convection heat loss and cold air drafts in a building resulting from air drafts from the room into the fireplace, while still permitting the fireplace to burn with an ample supply of fresh air.

Another object of the present invention is to provide a concealed fireplace door assembly that is easy to maintain, install and remove.

SUMMARY OF THE INVENTION

In accordance with the present invention, a fireplace front for a fireplace positioned in a room of an enclosure comprises a concealed door pocket formed in the side of the fireplace adjacent to the front thereof and a fireplace door slidably mounted for movement into and out of the door pocket from an open position, wherein the door is concealed in the door pocket, to a closed position, wherein the door covers the fireplace opening in front of the fireplace. The door is formed such that when the fireplace door is closed, the fireplace opening is sealed, at least when a fire is burning in the fireplace. A fresh air vent is provided for introducing fresh air from the outside of the enclosure into the interior of the fireplace when the door is closed. The vent includes a damper for opening and closing the vent.

This fireplace door seals the fireplace opening by means of seal mechanism, which is mounted at the outer periphery of the front of the fireplace and immediately behind the fireplace door. The door can be moved easily past the seal mechanism in sliding between its open and closed positions, but the seal mechanism resiliently engages the door and provides a substantially air tight seal between the door and the seal mechanism when the fireplace door is closed and the fire is burning in the fireplace. The burning fire creates an updraft from the fireplace, which in turn causes the pressure in the fireplace to be lower than the pressure in the room. This pressure differential urges the fireplace door inwardly against the seal and seals the fireplace front.

The vent mechanism of the present invention comprises a vent conduit leading from an inlet outside of the enclosure to an outlet located in a vent pocket, which is positioned adjacent to the fireplace front. An airtight shield separates the two pockets. The vent pocket includes an outlet at the edge of the fireplace for admitting fresh air into the fireplace behind the fireplace door. The damper for opening and closing the vent is mounted in the outlet of the vent pocket.

The fireplace door of the present invention is slidably mounted for longitudinal movement along a frame mechanism extending from the interior of the door pocket across the front of the fireplace. The frame mechanism includes a track that is fastened at the top of the fireplace and door pocket, and a carriage assembly that rides along the track. The door is releasably mounted on the carriage by means of a door mounting mechanism. The frame mechanism is sealed so that air cannot enter into the fireplace around the top of the fireplace door through the frame when the fireplace door is closed.

One feature of the present invention is that the track is formed in at least two sections which are aligned end-to-end. A first section is mounted in the door pocket at the top thereof, and a second section is mounted at the top of the fireplace opening. The length of each section is less than the width of the fireplace opening, so that the sections can be unfastened and removed individually from the fireplace.

Preferably, the separate track sections are connected together by means of a collar that fits over the abutting ends of the sections and supports such ends. The length of each section is less than the distance between the outer end of the collar and the opposite side of the fireplace opening so as to permit removal of the sections from the fireplace opening.

In another aspect of the present invention, the door mounting mechanism comprises at least two mounting arms extending downwardly from the carriage assembly, with the mounting arms being spaced apart and positioned above the fireplace door. A horizontally disposed mounting frame is releasably attached to the mounting arms and suspended between them. The mounting frame includes a horizontal flange thereon with at least two spaced slots being formed inwardly from the forward edge (the edge facing the room) of the flange. The fireplace door includes at least two mounting studs attached to and extending upwardly from the door. Each stud includes a shank portion adjacent the door and a flared end at the top of the shank portion. The studs are formed and spaced apart such that the shank portions fit into the slots in the flange, but the flared ends are wider than the slots and prevent the door from moving downwardly once the studs have been inserted in the slot. The door is thereby suspended from the mounting frame.

A locking mechanism is provided for releasably locking the studs in the slots once they have been inserted, so as to prevent the door from invertently falling off the mounting flange. Desirably, the locking mechanism comprises an elongated spring clip mounted on the top of the flange on one side of each slot and extending across a portion of the slot. The spring clip is positioned such that it lies between the stud and the open end of the slot when the stud is fully inserted into the slot. The spring clip prevents the stud from moving past the spring clip and out of the slot when the spring clip lays flat against the flange. The spring clip is resiliently liftable away from the top of the flange to permit the studs to be inserted into and removed from the slots in mounting and dismounting the fireplace door in the fireplace.

The mounting frame preferably is a C-channel member with an open side of the channel facing out of the fireplace. The upper side of the channel is bolted to the mounting arms, and the lower side acts as the flange of the mounting frame, with the slots being formed in the lower side.

In another aspect of the present invention, each mounting arm comprises a narrow shank with an outwardly flared lower end thereon. The frame of the fireplace door comprises a key hole shaped aperture therein immediately below each mounting arm. Each key hole shaped aperture is formed so that the flared end of each mounting arm fits through a first, enlarged portion of the aperture but not through a second, more narrow portion of the aperture. Only the shank fits through this second portion. The door is mounted on the mounting arms by fitting the flared ends of the mounting arms through the enlarged portions of the apertures and then moving the door over on the mounting arms so that the flared ends are positioned under the second portions of the apertures. An upwardly extending recess is formed under the second portions of the apertures in order to retain the flared ends in position under said second portions of the apertures when the door is suspended from the mounting arms.

Another feature of the present invention is that the concealed door mechanism and the vent mechanism can be formed as a single prefabricated unit, which can be easily mounted in a fireplace opening during construction of the fireplace. Thus, all of the moving parts and seals can be assembled and tested before installation.

One of the important advantages of the present invention is that it permits the front of the fireplace to be sealed off, thereby eliminating all drafts through the fireplace, while at the same time providing an independent air supply so that the fire can continue to burn brightly and provide radiant heat through the room in which the fireplace is located. With this apparatus, cold drafts in other rooms in the building are eliminated, and the problem of a lack of a draft or a draft that draws water in under the door is eliminated. Similarly, the convection heat loss attendant to the flow of warm air from a room into a fireplace and up the chimney is avoided. The elimination of the convection heat loss, which causes a particularly high loss of heat during the night, thus makes it possible to enjoy a fireplace with the door open or closed while the occupants of the building are awake and then permits the fireplace to be closed off for the night. The fireplace can then slowly die out and the fireplace flue remain open for the rest of the night without causing heat loss from the building.

The construction of the fireplace front itself, aside from the above discussed advantages, is advantageous in that the concealed fireplace door and associated vent pocket are conveniently and simply fabricated as a single unit, which is easily mountable in a fireplace during fireplace construction. Moreover, the mounting mechanism for releasably mounting the door in the movable carriage of the mounting frame is simple and inexpensive and yet provides for secure mounting of the door and easy installation and removal of the door. The two piece track permits easy installation and removal of the mounting frame itself.

These and other advantages and features of the present invention will hereinafter appear and, for purposes of illustration, but not of limitation, a preferred embodiment of the present invention is described in detail below and shown in the appended drawings.

DETAILED DESCRIPTION OF PREFERRED EMBODIMENTS

Figure 1:
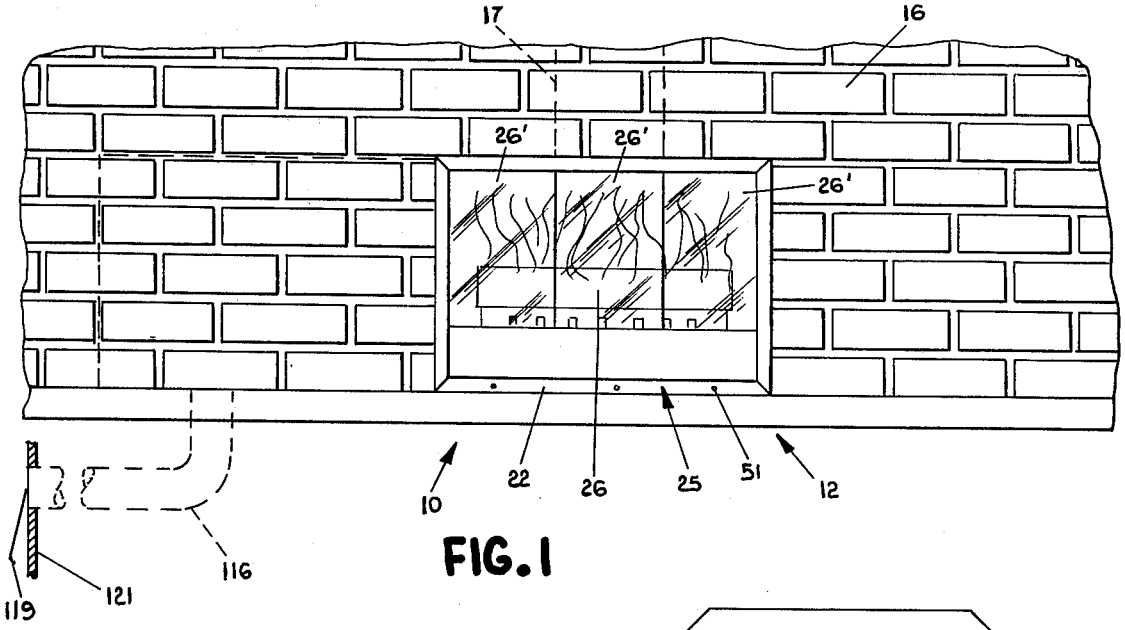
FIG. 1 is a pictorial front elevational view of a fireplace employing the fireplace front of the present invention.

Referring now to the drawings, a fireplace front 10 in accordance with the present invention is shown in FIG. 1 mounted in a fireplace 12. Fireplace 12 includes a fireplace recess 14 in a wall 16 having a brick facing or veneer. A flue or draft 17 is located at the upper portion of the fireplace.

Fireplace front 10 includes a concealed door pocket 18 formed in the side of the fireplace adjacent the fireplace opening 20. A slidable fireplace door 22 is mounted on a frame mechanism 24 for slidable movement from an open position in the door pocket (as shown by phantom FIG.22' in FIG. 2), to a closed position over the fireplace front, and the outer end of the door fits in a channel 53 in the side of the fireplace.

Door 22 is formed of a metal frame 25 and a glass or similar insert 26. Desirably, the glass insert is formed of three separate abutting sections of glass 26' in order to prevent warpage through heat expansion.

A metal plate 41 extends across the lower portion of the door. The glass section 26' rest in a channel 43 at the top of plate 41, and a J-shaped lower end 45 of plate 41 fits into the U-shaped lower member 47 of frame 25. The door slides across the fireplace front over a T-shaped runner 49 mounted in the fireplace. Member 47 can be raised or lowered to insure a close fit on runner 49. Set screw 51 or similar fasteners are used to fix the position of lower member 47.

When door 22 is closed, the door completely covers the fireplace opening. Thus, if any air draft is to enter the fireplace from the room, the air must flow around the edges of the door. A seal mechanism 28 is positioned at the outer periphery of the fireplace opening immediately behind the upper and side edges of the door. Seal mechanism 28 seals the junction between edge of the door and the fireplace opening to prevent flow around the edge of the door and into the fireplace when a fire is burning in the fireplace and the door is closed. Seal 28 may be formed of any conventional sealing material that is capable of withstanding the heat produced in the fireplace. Seal mechanism 28 is positioned so that the door can slide easily between its open and closed positions without substantial frictional engagement of the seal.

A seaing engagement between seal 28 and door 22 is produced by the existence of a fire in the fireplace. When a fire is burning, the updraft through the fireplace flue produces a lower pressure in the interior of the fireplace than in the room. This pressure differential urges the closed door inwardly toward the fireplace so that it bears resiliently against the seal mechanism 28. This sealing relationship minimizes air flow from the room into the fireplace but does not prevent the door from being opened or closed manually.

Frame mechanism 24 comprises a track 37 in the form of an inverted channel member which is attached to a Z-bar beam 39 extending the full width of the fireplace and the concealed pocket. Z-bar beam 39 is a conventional component which is present in most conventional fireplaces. Z-bar beam 39 is mounted in the fireplace by means of a lower flange 30 mounted between adjacent bricks of wall 16. A vertical portion 32 extends upwardly from flange 30 and an upper flange 34 extends inwardly into the fireplace opening from the top of vertical portion 32. Track 37 is mounted to upper flange 34 by means of fasteners 36 spaced along the length of the track.

The inverted channel member of track 37 includes an upper portion 38 and depending sides 40 extending downwardly from each side of upper portion 38. Flanges 42 extend inwardly from the lower edges of sides 40 a portion of the way across the channel, leaving an open portion 44 between the ends of the flanges.

A carriage assembly 48 comprising a pair of wheeled carriages 46 are positioned in the interior of channel member 37 for longitudinal movement along the channel member. Each carriage 46 comprises a U-shaped chassis 49 with four wheels 50 mounted in pairs on opposite sides of the chassis by means of axles 52 attached to the chassis. Wheels 50 are positioned so that they ride along flanges 42 of the track.

Figure 7:
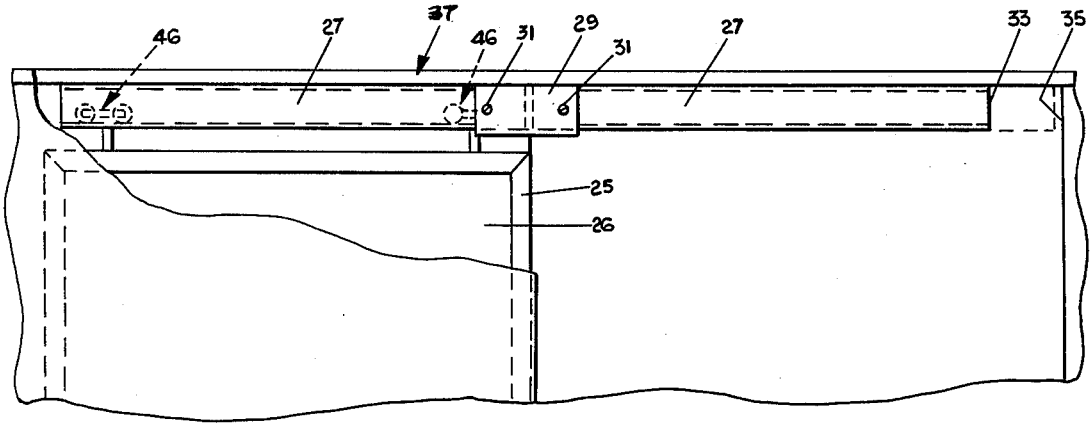
FIG. 7 is a fragmentary front elevational view showing the mounting track of the present invention, with a portion of the fireplace in front of the concealed pocket being broken away.

As shown in FIG. 7 track 37 comprises two aligned and abutting sections 27 of channel member, with the two sections of channel abutting at the opening of the door pocket into the fireplace opening. A collar 29 fits over abutting ends of sections 27, and fasteners 31 releasably hold sections 27 together in collar 29.

As noted in FIG. 7, the right hand end 33 of the channel member positioned over the fireplace opening is spaced apart from the right hand end 35 of the fireplace opening. The track is formed in two sections in order to permit removal of the track from the fireplace opening. Without a two section track, the track could not be removed from the concealed door pocket without dismantling wall 16. With track 37 formed in two sections 27 of channel member, one section can first be dismounted from the fireplace and removed and then the remaining section can be dismounted and moved over the fireplace and removed.

Collar 29 holds the two sections in place by means of fasteners 31 until it is desired to remove them. In order to remove the section positioned over the fireplace opening, the fastener 31 holding it to collar 29 is released and that section is moved to the right (FIG. 7 orientation) until the left hand end of the section clears the outer edge of collar 29. In order to permit sufficient lateral movement of the section to the right in order to permit the section to clear collar 29, it is necessary that right hand end 33 of this section is spaced apart from the right hand edge of the fireplace front a sufficient distance to permit the required movement of the section. This means that the distance between the right hand edge of the collar and the right hand edge 35 of the fireplace front must be greater than the length of each section 27.

After one section 27 has been released fromthe collar and moved to the right and removed from the fireplace, the remaining section (the section inside the concealed pocket) can be released from the collar, slid to the right, and removed from the fireplace opening. This structure permits easy installation and removal of the frame assembly from the fireplace after it has been installed. Fireplace door 22 is suspended from carriages 46 by means of mounting arms 54 which are attached to each carriage and extend downwardly therefrom through opening 44 at the bottom of the channel member. Each mounting arm comprises flared upper end 56 and a shank portion 58 that extends downwardly from the carriage through an opening in chassis 48. Flared end 56 holds mounting arm 54 in place in the carriage. The lower end of mounting arm 54 is threaded and a nut 60 is threaded on the end.

A mounting frame 62 is attached to the lower ends of mounting arms 54 and suspended between them. Mounting frame 62 is a C-frame member having an open section that faces the inlet to the fireplace. C-frame 62 comprises upper and lower sides 64 and 66 and a vertical back portion 68 that extends downwardly between the upper and lower sides of the C-frame. Upper side 64 includes a pair of spaced openings through which the lower ends of the mounting arms fit. Nuts 60 hold the C-frame on the mounting arms.

The lower side 66 of the C-frame is a horizontally extending mounting flange on which the door is mounted. Lower side 66 includes a pair of spaced slots 70 extending inwardly from the edge of the side.

A stud 72 is mounted on each end of the top side of the door directly below slots 70. Studs 72 include a flared upper end 74 and a shank portion 76. Narrower tail portion 78 fits through an opening in door frame 24. The lower end of tail portion 78 is flared outwardly after it has been fitted through the opening in order to fasten the studs securely in the top of frame. Shank 76 is sufficiently narrow to fit into slot 70, while flared head 74 is wider than slot 70.

In order to mount the door on mounting frame 62, the studs are fitted into the slots, and the door is suspended by engagement of flared head 74 with the lower side 66 of the mounting frame.

Once the door has been mounted on the mounting frame, a locking mechanism 80 is employed to retain the door on the mounting frame. Locking mechanism 80 comprises an elongated spring clip 82 fastened by means of rivets 84 to the upper side of flange 66. Spring clip 82 lies over the top of slot 70 between stud 72 and the outer edge of the slot. With spring clip 82 laying flat against the flange, it prevents the stud from moving outwardly in the slot to disengage the door from flange 66. The spring clip is fastened to the upper side of flange 66 at one end and includes a handle 86 at the other end. Handle 86 permits the spring clip to be manually raised or lifted above the top surface of flange 66, so that stud 72 can be slipped underneath the spring clip. The door can thus be easily mounted and dismounted from the mounting frame simply by raising the spring clip and slipping the stud into and out of slots 70.

Figure 9:
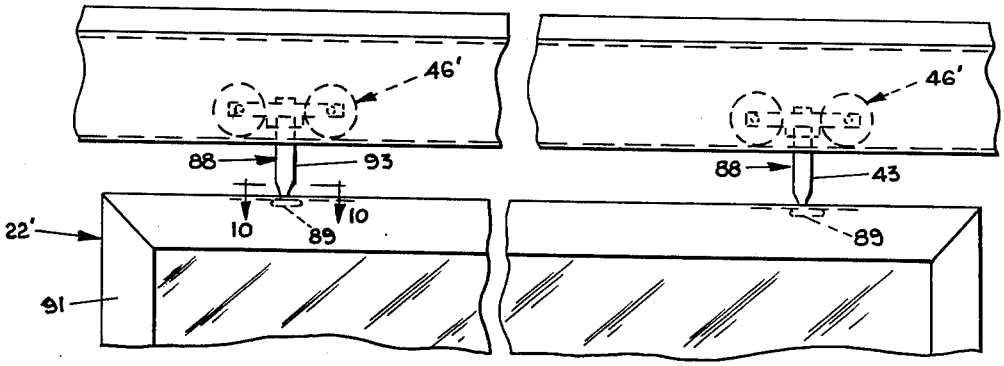
FIG. 9 is a fragmentary and partially broken front elevational view showing a second type of mounting mechanism for releasably suspending the fireplace door from the movable carriage.
Figure 10:
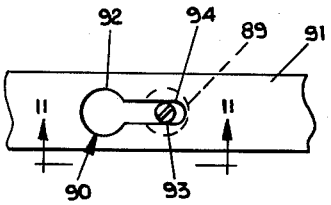
FIG. 10 is a view taken along line 10—10 of FIG. 9.
Figure 11:
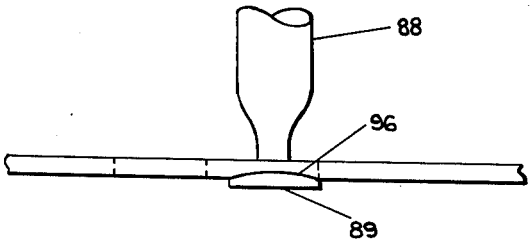
FIG. 11 is a fragmentary view taken along line 11—11 of FIG. 10

A second mechanism for mounting the door frame to removable carriages 46 is shown in FIGS. 9–11. In this embodiment, each mounting arm 88 extending downwardly from each carriage 46' includes as shank 93, which is tapered inwardly adjacent the lower end thereof, and a flared end 89, which is formed on the lower end of shank 93. Frame 91 of door 22' is provided with a key hole shaped opening 90 which includes an enlarged portion 92 and a narrower portion 94. Enlarged portion 92 is sufficiently large to permit end 89 of the mounting arm to fit therethrough, but smaller portion 94 is large enough only to permit the shank 93 of the mounting arm to fit therethrough. In order to mount the door on the mounting arms, flared ends 89 are fitted through the large portions of openings 90, and then the door is moved over on the mounting arms such that the flared ends are positioned under narrow portions 94. The door is then lowered into engagement with the top surfaces of end 89, and flared ends 89 hold the door in place on the mounting arm. The underside 96 of narrow portion 94 is recessed upwardly such that the flared end 89 fits into the recessed portion when the door is suspended from the mounting arm. This recessed portion holds the mounting arm in narrow portion 94 and prevents the door from falling off the mounting arm.

As described above, when the concealed fireplace door of the present invention is moved from its concealed position, wherein the fireplace front is open, to its closed position, the fireplace front is sealed closed, eliminating all air draft from the room into the fireplace.

Figure 2:
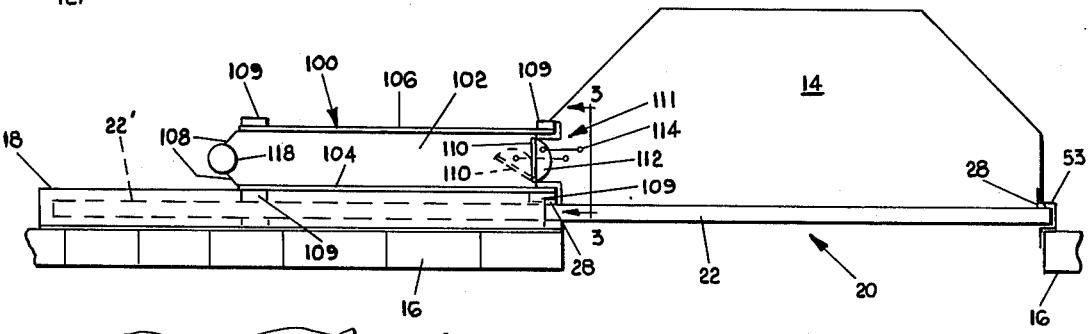
FIG. 2 is a plan view showing the fireplace front of the present invention mounted in a fireplace.
Figure 3:
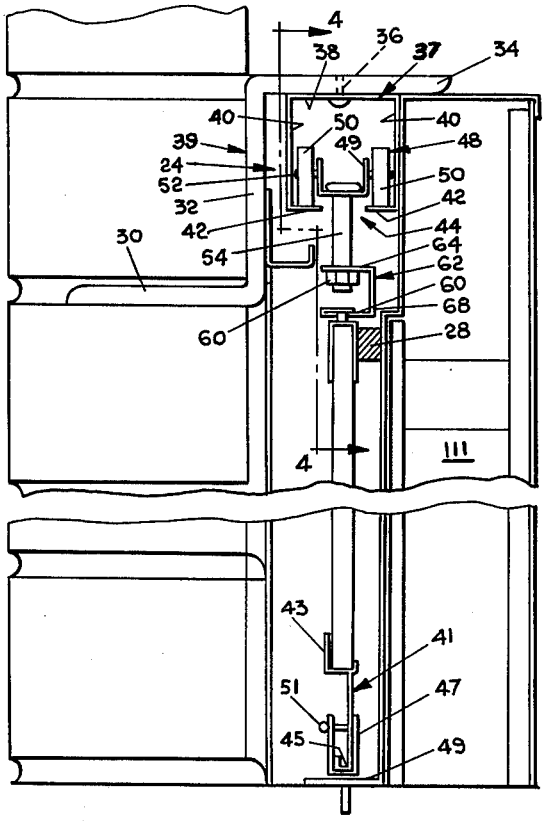
FIG. 3 is a partially sectional view taken along line 3—3 of FIG. 2.
Figure 4:
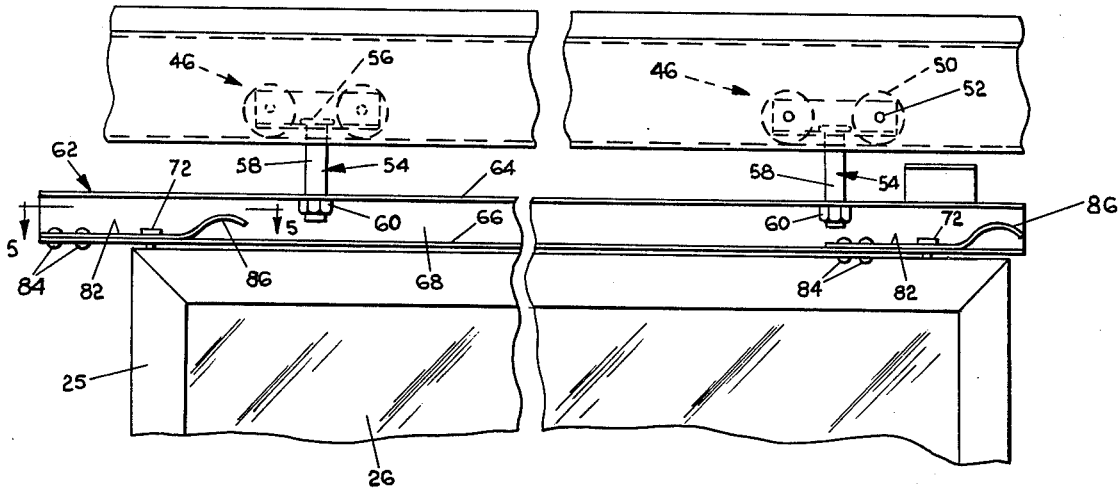
FIG. 4 is a partially broken view taken along line 4—4 of FIG. 3.
Figure 5:
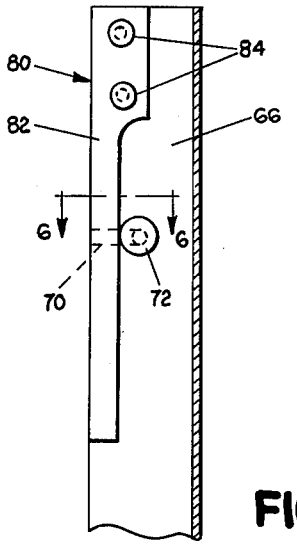
FIG. 5 is a view taken along line 5—5 of FIG. 4.
Figure 6:
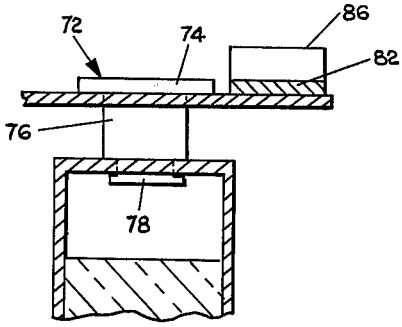
FIG. 6 is an enlarged cross sectional view taken along line 6—6 of FIG. 5.

Another aspect of the present invention is the provision of a independent air vent mechanism 100 in combination with the sealed fireplace door in order to ensure that there is always an adequate supply of air to the fireplace, even when the door is closed. Vent mechanism 100 preferably is incorporated into a vent pocket 102 which is positioned adjacent to and parallel to door pocket 18 and immediately behind door pocket 18. An air tight shield 104 is positioned between the vent pocket 102 and door pocket 18 in order to ensure that air cannot flow from vent pocket 102 outwardly to the room through door pocket 18 and, conversely, that no air draft in the room can flow into the fire place through door pocket 18 and vent pocket 102. A front shield 106 encloses the front edge of vent pocket 102 and a back portion 108 encloses the back portion. The shields are mounted on vertical support members 109. The vertical portion 111 of vent pocket 102 adjacent the edge of the fireplace is the outlet of the vent mechanism. This outlet is closed and opened by means of a pivotable damper 110, which pivots from a closed position (as shown in FIG. 2) to an open position (as shown in dotted FIG. 110' in FIG. 2). A curved mounting plate 112 is attached to the damper, and a damper lever 114 is mounted on the mounting plate. Damper lever 114 permits the damper to be manually opened and closed from the interior of the fireplace.

Air is provided to vent pocket 102 by means of a vent conduit 116 which leads to an opening 118 at the left hand end of vent pocket 102 (FIG. 2 orientation) from an inlet opening 119 positioned outside of the building enclosure 121 in which the fireplace is located. By drawing fresh air into the fireplace opening from a position outside the dwelling, air drafts through cracks around windows or under doors in the building are eliminated. Moreover, by having an independent air supply from outside the building, the fire can continue to burn brightly whenever the fireplace door is closed. Even when the fireplace door is open, the independent air supply provides an independent supply of air to the fire and minimizes the amount of air drafts from the room into the fireplace.

Figure 8:
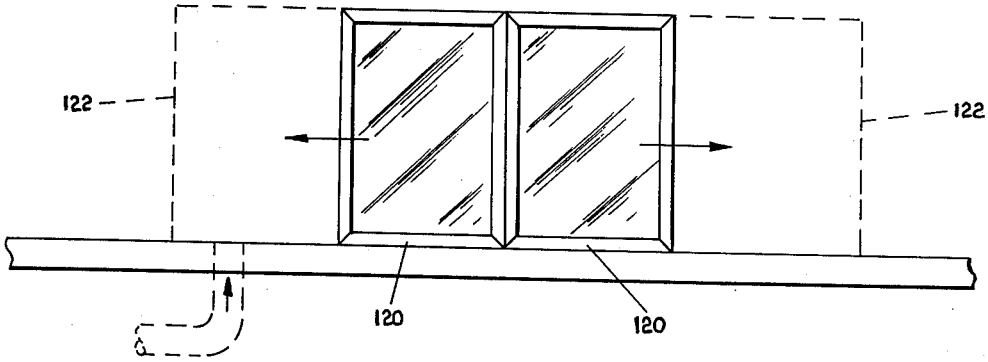
FIG. 8 is a pictorial front elevational view showing the use of concealed pockets on both sides of the fireplace for a two piece fireplace door.

A second embodiment of a fireplace door mechanism is shown in FIG. 8. In this embodiment, two separate fireplace doors 120 are slidably mounted for movement into and out of sealed pockets 122 on both sides of the fireplace opening. By providing a two piece door and concealed pockets on both sides of the fireplace, less room is necessary for a concealed pocket on one side of the fireplace. This type of design permits more variation in the size of fireplace that can be employed with the apparatus of the present invention.

It should be understood that the embodiments described herein are merely exemplary of the preferred practice of the present invention and that various changes and modifications may be made in the arrangements and details of construction of the elements described herein without the departing from the spirit and scope of the present invention.

The embodiments of the invention in which an exclusive property or privilege is claimed as follows:

1. A fireplace front for a fireplace positioned in a room of an enclosure comprising:

a concealed door pocket formed at the side of the fireplace adjacent the front thereof;

a fireplace door slidably mounted for movement into and out of the door pocket from an open position, wherein the door is concealed in the door pocket, to a closed position, wherein the door covers the fireplace opening at the front of the fireplace, the door being formed such that when the fireplace door is closed and a fire is burning in the fireplace, the fireplace opening is sealed so as to substantially prevent air flow from the room into the fireplace; and vent means for providing fresh air from outside the enclosure to the interior of the fireplace, said vent means being capable of providing an independent supply of air to the fireplace to keep a fire burning even when the fireplace door is sealed closed, said vent means comprising a vent pocket in the fireplace front and a vent conduit leading from an inlet outside the enclosure to the vent pocket, said vent pocket being formed adjacent and behind the door pocket, an air-tight shield separating the two pockets, the vent pocket having outlet means at the edge of the fireplace for admitting fresh air into the fireplace behind the fireplace door, said vent means further comprising damper means in the outlet means of the vent pocket for opening and closing the vent means, the vent pocket and concealed door pocket being formed as a single integral unit which can be mounted as an assembly into a fireplace during construction of the fireplace.

2. A fireplace front according to claim 1 and further comprising seal means positioned such that when the fireplace door is closed, the seal means lies between the fireplace door and the outer periphery of the front of the fireplace, said seal means permitting the door to be moved easily between its open and closed positions but being resiliently pressed between the door and the fireplace front to create an air seal between the edges of the door and the fireplace front when the fireplace door is closed and fire is burning in the fireplace, the burning fire creating an updraft from the fireplace and a resultant pressure drop in the fireplace, said pressure drop urging the fireplace door inwardly against the seal means to seal the fireplace front.

3. A fireplace front according to claim 1 wherein the vent pocket outlet means comprises a vertical outlet opening at the side of the fireplace and the damper means comprises a damper plate pivotably mountd in the outlet opening and having an open position, wherein the outlet opening is open, and a closed position, wherein the outlet opening is covered and closed, said damper means further including a manually operable lever means for opening and closing the damper plate.

4. A fireplace front for a fireplace positioned in a room of an enclosure comprising:

a concealed door pocket formed at the side of the fireplace adjacent the front thereof;

a fireplace door slidably mounted for movement into and out of the door pocket from an open position, wherein the door is concealed in the door pocket, to a closed position, wherein the door covers the fireplace opening at the front of the fireplace, the door being formed such that when the fireplace door is closed and a fire is burning in the fireplace, the fireplace opening is sealed so as to substantially prevent air flow from the room into the fireplace;

a frame mechanism slidably supporting the fireplace door for longitudinal movement into and out of the door pocket, the frame mechanism extending from the interior of the door pocket across the front of the fireplace, the frame mechanism including a track that is fastened to the top of the fireplace and door pocket, a carriage assembly that rides along the track, and door mounting means for releasably suspending the fireplace door from the carriage assembly, the frame mechanism being sealed such that air cannot enter the fireplace around the top of the fireplace door and through the frame mechanism, the track being formed in at least two sections aligned end to end and abutting each other, a first section being mounted in the door pocket at the top thereof and a second section being mounted at the top of the fireplace opening, said sections being releasably fastened in position, the length of each section being less than the width of the fireplace opening, such that the sections can be unfastened and removed individually from the fireplace; and vent means for providing fresh air from outside the enclosure to the interior of the fireplace, said vent means being capable of providing an independent supply of air to the fireplace to keep a fire burning even when the fireplace door is sealed closed.

5. A fireplace front according to claim 4 wherein:

the track sections each comprise a channel member having a horizontal top, vertical sides depending from opposite sides of the top, and flanges extending inwardly at right angles from the bottoms of the sides, the inner ends of the flanges being spaced apart to accommodate the door mounting means therebetween;

the carriage assembly comprises a pair of four wheeled carriages that ride along the flanges of the channel members, said carriages being spaced apart and positioned above the fireplace door; and the door mounting means comprises a mounting arm that extends downwardly from each carriage and releasable attachment means for releasably attaching the door to the mounting arms.

6. A fireplace front according to claim 5 and further comprising a collar attached to the top of the fireplace and fitting over the abutting ends of the track section, the sections being releasably attached to the collar, the length of the sections being less than the distance between the outer end of the collar and the opposite side of the fireplace opening, such that each section can be moved out of engagement with the collar and then removed from the fireplace opening.

7. A fireplace front for a fireplace posiitoned in a room of an enclosure comprising:

a concealed door pocket formed at the side of the fireplace adjacent the front thereof;

a fireplace door slidably mounted for movement into and out of the door pocket from an open position, wherein the door is concealed in the door pocket, to a closed position, wherein the door covers the fireplace opening at the front of the fireplace, the door being formed such that when the fireplace door is closed and a fire is burning in the fireplace, the fireplace opening is sealed so as to substantially prevent air flow from the room into the fireplace;

a frame mechanism slidably supporting the fireplace door for longitudinal movement into and out of the door pocket, the frame mechanism extending from the interior of the door pocket across the front of the fireplace, the frame mechanism including a track that is fastened to the top of the fireplace and door pocket, a carriage assembly that rides along the track, and door mounting means for releasably suspending the fireplace door from the carriage assembly, the frame mechanism being sealed such that air cannot enter the fireplace around the top of the fireplace door and through the frame mechanism;

the door mounting means comprising at least two mounting studs spaced apart and extending upwardly from the top of the door, each stud including a shank portion adjacent the door and a flared end on the top of the shank portion, at least two mounting arms extending downwardly from the carriage assembly, the mounting arms being spaced apart and positioned above the fireplace door, a horizontally disposed mounting frame being releasably attached to the mounting arms and suspended therebetween, said mounting frame having a flange thereon with at least two spaced slots being formed in the flange, the slots being formed such that they removably receive the studs therein at an entry position and the studs are thereafter movable to a holding position in the slots, the slots being formed such that when the studs have been inserted into the slots and are positioned in the holding positions, the flared ends of the studs engage the flange on the sides of the slots, the door being suspended from the mounting frame by engagement of the flared ends of the studs with the flange; and vent means for providing fresh air from outside the enclosure to the interior of the fireplace, said vent means being capable of providing an independent supply of air to the fireplace to keep a fire burning even when the fireplace door is sealed closed.

8. A fireplace front according to claim 7 and further comprising locking means for releasably locking the studs in their holding positions in the slots so as to prevent the door from inadvertently falling off the mounting flange, said locking means being releasable to permit easy mounting and dismounting the fireplace door on mounting flange.

9. A fireplace front according to claim 8 wherein:

the slots are elongated slots extending inwardly from an edge of the flange, the studs fitting into the slots at the edge of the flange and resting on the sides of the flange on the interior of the slots; and the locking means comprises spring clip means attached to the top of the flange and extending across a portion of each slot, the spring clip means being positioned between the stud and the open end of the slot when the stud is fully inserted into the slot, the spring clip means preventing the stud from moving past the spring clip when the spring clip lays flat against the flange, the spring clip being resiliently liftable away from the top of the flange to permit the studs to be inserted in and removed from the slots in mounting and dismounting the fireplace door in the fireplace.

10. A fireplace door according to claim 9 wherein the mounting frame is a C-channel member with the open side of the channel facing the outside of the fireplace, the C-channel member having horizontal upper and lower sides and a vertical back side, the mounting arms passing through openings in the upper side and being attached to said upper side by means of nuts threaded on threaded ends of the mounting arms below the openings in the upper side, the lower side of the C-channel being the mounting flange and the slots extending inwardly into the mounting flange from the outer edge of the mounting flange.

11. A fireplace front for a fireplace positioned in a room of an enclosure comprising:

a concealed door pocket formed at the side of the fireplace adjacent the front thereof;

a fireplace door slidably mounted for movement into and out of the door pocket from an open position, wherein the door is concealed in the door pocket, to a closed position, wherein the door covers the fireplace opening at the front of the fireplace, the door being formed such that when the fireplace door is closed and a fire is burning in the fireplace, the fireplace opening is sealed so as to substantially prevent air flow from the room into the fireplace;

a frame mechanism slidably supporting the fireplace door for longitudinal movement into and out of the door pocket, the frame mechanism extending from the interior of the door pocket across the front of the fireplace, the frame mechanism including a track that is fastened to the top of the fireplace and door pocket, a carriage assembly that rides along the track, and door mounting means for releasably suspending the fireplace door from the carriage assembly, the frame mechanism being sealed such that air cannot enter the fireplace around the top of the fireplace door and through the frame mechanism;

the door mounting means comprising at least two mounting arms extending downwardly from the carriage assembly, the mounting arms being spaced apart and positioned above the fireplace door, each mounting arm comprising a shank with an outwardly flared lower end thereon, the fireplace door having a key-shaped aperture therein for each mounting arm, each said aperture being formed and positioned such that the flared end of a mounting arm fits through a first portion of the aperture but not through a second portion of the aperture, with only the shank fitting through the second portion, the two portions of the aperture being connected such that the door can be mounted on the mounting arms by first fitting the flared ends through the first portions of the apertures in the door and then moving the door such that the shanks of the mounting arms extend through said secnd portions of the apertures, the door frame surrounding the second portion of each aperture being recessed upwardly such that the flared end of the mounting arm rests in said recessed portion and is urged thereby to remain in the second portion once the door has been mounted on the mounted arms, the door being removable by lifting the door so that the flared ends clear the recessed second portions and then sliding the door over until the flared ends mate with said first portions; and vent means for providing fresh air from outside the enclosure to the interior of the fireplace, said vent means being capable of providing an independent support of air to the fireplace to keep a fire burning even when the fireplace door is sealed closed.

* * * * *